United States Patent [19]

Wagner

[11] Patent Number: 5,000,101

[45] Date of Patent: Mar. 19, 1991

[54] HAZARDOUS WASTE RECLAMATION PROCESS

[76] Inventor: Anthony S. Wagner, 13709 Hwy. 71 W., Bee Caves, Tex. 78738-3112

[21] Appl. No.: 524,278

[22] Filed: May 16, 1990

[30] Foreign Application Priority Data

May 25, 1989 [SE] Sweden ..... 8901855

[51] Int. Cl.[5] ..... F23G 7/04

[52] U.S. Cl. ..... 110/346; 110/235; 110/238; 110/250; 110/204; 422/184

[58] Field of Search ..... 110/204, 250, 235, 346, 110/238; 422/184; 423/659

[56] References Cited

U.S. PATENT DOCUMENTS 4,497,782 2/1985 Howell et al. .
4,526,677 7/1985 Grantham et al. .
4,547,620 10/1985 Miyata et al. .
4,552,667 11/1985 Shultz .
4,581,130 4/1986 Globus .
4,592,844 6/1986 Layman et al. .
4,601,817 7/1986 Globus .
4,602,574 7/1986 Bach et al. ..... 110/250 X
4,666,696 5/1987 Shultz .
4,787,320 11/1988 Raaness et al. ..... 110/250

FOREIGN PATENT DOCUMENTS 945824 4/1974 Canada ..... 110/250

*Primary Examiner*—Edward G. Favors
*Attorney, Agent, or Firm*—Joseph F. Long

[57] ABSTRACT

This Hazardous Waste Reclamation process pyrolyzes hazardous waste such as PCB (polychloro-biphenyl) in a closed system in a molten alloy, containing some aluminum, at a minimum of 800 degrees C. to form activated carbon that is recovered from the circulating exit gas stream and an impure alloy ingot containing unreacted metals and metal salts that are saleable to a metal processor as a high grade ore. The composition of the alloy may be varied to assure maximum reaction to nontoxic alloy salts that remain in the ingot.

19 Claims, 1 Drawing Sheet

HAZARDOUS WASTE RECLAMATION PROCESS

BACKGROUND

With increasing population of people and manufactured products there is an ever increasing amount of waste product. There is also increasing awareness of the need for protection of the environment and in many cases, cleaning up of waste dumps already in existence.

This present invention covers a simplified process for catalytic decomposition and pyrolysis of hazardous wastes in a closed system to form saleable products in the form of activated carbon and metal alloy ingots containing various impurities. These ingots may be sold back to processors of aluminum or steel and are considered a very high grade one.

This invention is uniquely different in simplicity and in using tailor-made alloys to decompose hazardous materials and to tie up simple and complex anions as saleable metallic salts while recovering carbon as carbon black from complete decomposition of the organic molecules. Such hazardous chemicals as polychlorobiphenyl (PCB) and trichloroethylene, and insecticides have been completely destroyed using this process.

We have considered the following patents in the prior art:

| Patent No. | Inventor | Date |
|---|---|---|
| 4,552,667 | C. G. Shultz | 11/12/1985 |
| 4,666,696 | C. G. Shultz | 5/19/1987 |
| 4,526,677 | Leroy F. Grantham et al. | 7/2/1985 |
| 4,497,782 | Samuel G. Howell et al. | 2/5/1985 |
| 4,592,844 | Robert G. Layman et al. | 6/3/1986 |
| 4,601,817 | Alfred R. Globus | 7/22/1986 |
| 4,581,130 | Alfred R. Globus | 4/8/1986 |
| 4,547,620 | Shigeo Miyata et al. | 10/15/1985 |

The patent to Shultz entitled Destruction of Nerve Gases and other Cholinesterase Inhibitors by Molten Metal Reduction is the closest prior art but differs quite markedly in at least the following major aspects:

1. Schultz uses a molten aluminum bed whereas this invention normally will use a molten alloy containing aluminum, copper, iron, zinc, and calcium or equivalent metals with the alloy being chosen to decompose a variety of hazardous wastes;
2. We use a platinum-palladium screen to catalyze the reactions whereas Shultz does not;
3. In our invention the hydrocarbon portion of the molecules are completely disintegrated whereas Shultz does not completely disintegrate the molecules and suggests using such compounds as lower alkenes in the off gas as fuels;
4. The molten alloy bed we use is designed to decompose a wide variety of compounds in addition to cholinesterose inhibitor agents such as nerve gas agents and insecticides;
5. The use of induction heating along with platinum catalysis may account for the fact that hydrocarbons are completely broken down in our process but not in the Shultz process.

SUMMARY OF THE INVENTION

This invention depends upon pyrolysis in a molten bed of an alloy at a minimum of 800 degrees C. to pyrolyze organic wastes such as waste medicinals, insecticides, trichloroethylene solvents, PCB's (polychlorobiphenyls), rubber gloves, blood contaminated towels, etc., to form an active finally divided carbon and metallic salts. The reaction may be platinum catalyzed and is carried out in a closed system so that aluminum and other metals used in the alloy react with oxygen thereby preventing formation of appreciable amounts of carbon monoxide. Components of this alloy were chosen as optimum to produce lowest energy salts from a wide variety of wastes containing Br., Cl., I, phosphate, etc.

By experiment, we have found that stainless steel in items such as hypodermic needles, disintegrate in the same copper, iron, zinc, calcium and aluminum alloy composition. Alloy compositions may be varied if only specific wastes are being treated but most alloy compositions used will contain aluminum which may react to form salts and also acts as an oxygen scavenger. Magnesium may also be used as an oxygen scavenger and we have found that magnesium may best be used by keeping the magnesium in a boat floating on the surface of the molten alloy.

The process operates as follows:

A reactor that may be heated to above 800 degrees C. either by gas firing or induction heating is charged with an alloy, usually containing approximately 5–15% iron, 5–15% Zinc, 5–15% calcium 5–15% copper and remainder aluminum, heated to form a molten metal pool or bed. Waste beer cans have been used quite successfully for the aluminum portion of the alloy charged. When the molten alloy bed is established, a liquid waste stream may be fed into internal reactor coils that extend close to the bottom of the molten bed. The multiple outlet openings of the coil may be covered with platinum screen or wire to act as a catalyst and to aid in dispersion of the inlet liquid. Platinum with palladium or platinum with rhodium or palladium may also function as a catalyst. Waste feed is controlled so that the reactor heater may maintain a temperature of at least 800 degrees C. Induction heating is used in a preferred embodiment to maintain the 800 degree C. Off gas from the reactor goes to a closed off gas system. The system includes a separator such as a cyclone separator to separate the bulk of the water from the finely divided carbon. In a preferred embodiment a water spray is controlled at the cyclone separator inlet to maintain the gas at less than boiling water temperature ahead of a circulating fan or pump. The water spray acts to coalesce the very fine active carbon formed by the pyrolysis. Water separated from the active carbon withdrawn from the separator is circulated through a cooling tower and back to the water spray.

The process as described may be built large enough to handle several thousand pounds of waste per hour and still be small enough to be mounted on a tractor trailer thereby increasing the utility for such applications as waste site clean ups.

DETAILED DESCRIPTION OF THE INVENTION

This invention uses an alloy of metals chosen to form the lowest energy level salts from decomposition of a variety of different hazardous or toxic waste streams containing:

Group I—Anions of fluorine, bromine, chlorine or Iodine;

Group II—Sulfides as well as combinations of halogens and sulfides;

Group III—Phosphates alone or bonded to hydrocarbons or with complex molecules also containing halogens;

Group IV—Complex anions such as phosphochlorides, chlorosulfides, halogenated oxides, dioxane, furans and E.P.A.'s hazardous compounds as listed in part 261, Subpart D.

Group V—Organic wastes such as leather, paper, or cloth.

The alloy chosen by this method comprises aluminum, copper, iron, calcium and zinc.

One preferred composition is 52% aluminum, 12% copper, 12% iron, 12% calcium and 12% zinc. These metals form a molten mass at about 800 degrees C. Depending upon particular waste being treated the percentage of any of these metals in the alloy could be changed markedly. The percentages have been chosen to allow treating a variety of hazardous wastes. To achieve essentially complete destruction of hazardous wastes wherein the molecules may contain phosphines, cyanides, metals, halides, carbon, hydrogen, oxygen, nitrogen, etc., to form activated carbon, hydrogen, water, metal oxides, and metal salts, we find that the waste to be treated is preferably introduced near the bottom of a molten alloy bed heated by induction heating with the outlet end or sparger covered loosely with a platinum screen to act as a catalyst and aid in dispersion of the incoming waste stream into the molten alloy.

In our prototype unit, the cylindrical shaped molten alloy bed in the reactor is heated to maintain approximately 800 degrees C. using an induction heater, with the heater coils closely wound around the reactor exterior By field test, we found that even stainless pipe would dissolve in this molten alloy quite rapidly at 800 degrees C. We use a ceramic feed line and a ceramic lined reactor.

We believe the induction heating by the electromagnetic field may aid in the reaction and may be responsible for dissolution of stainless steel in such wastes as used hypodermic needles.

Actual tests have shown complete disintegration of complex PCB's (polychlorobiphenyl) and many insecticides to give free activated carbon in the off gas with the chlorine phosporous, etc. remaining in the melt.

The process may be advantageously described in more detail from the drawings. In general the drawings are meant to be illustrative only and many changes could be made by one of normal skill in the engineering art so we only wish to be limited to general principles and concepts as outlined in these specifications and claims.

Figure 1:
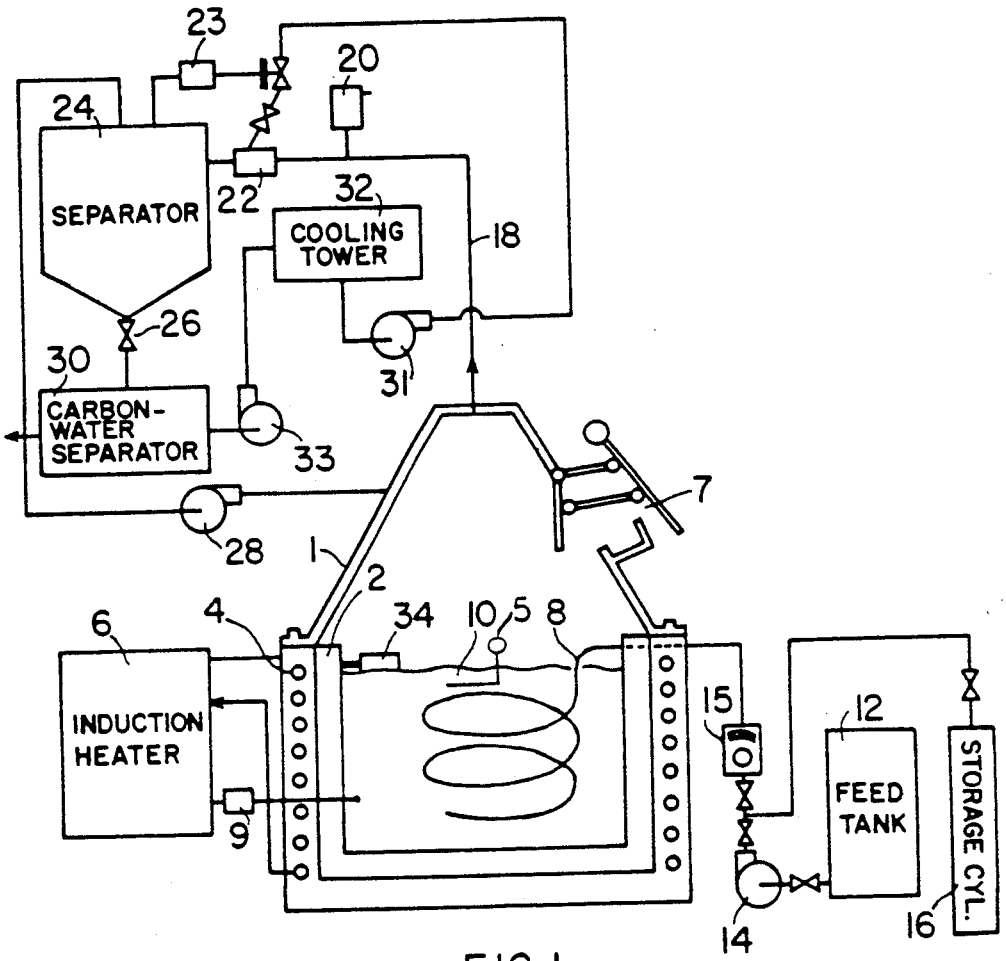
FIG. 1 shows major components of the process.

In FIG. 1 we show reactor body 2 in an embodiment wherein heat to maintain the molten alloy bed 10 above about 800 degrees C. is supplied through induction heating coils 4 by induction heater 6. Temperature controller 9 may be used to hold the temperature at a desired point. In our prototype unit, induction heating coils 4 are water cooled and when no power is applied may be used for cooling of the molten alloy bed prior to discharge. The interior liquid feed coils 8 are removed prior to cooling and a metal hook 5 is partially immersed in the molten alloy to be used to facilitate handling of the cooled ingot. On cooling the ingot shrinks sufficiently that it may easily be lifted out by mechanical means. In embodiments where a removeable stainless steel magnesium loaded boat 34 is used as oxygen scavenger this boat would be removed also while the alloy bed 10 is still molten.

The airtight but removeable top head 1 contains a solids loading chute 7 that may be set up with a double reverse acting door so that when open to charge solid waste the top head is closed and as the top chute door closes to admit waste to the molten bed 10 the other top chute door closes airtight. It is desirable to purge most of the air cut of the charging chute before admitting the waste to minimize metal oxide formation in the anearobic system. Of course, the aluminum or magnesium also rapidly reacts to remove oxygen from the gas stream above the molten alloy bed 10.

The hazardous waste to be treated may be gaseous, liquid, solid or a slurry. When it is a liquid or slurry, a hold up tank 12 properly vented to control vapors would be used. Hold up tank discharge pump 14 would probably be a diaphragm pump to handle both slurry and liquids and controlled through controller 15 in order that waste feed does not exceed the capacity of induction heater 6 to maintain proper alloy bed temperature. Various types of commercially available controllers are adequate. Any air or waste liquid may be purged from the system piping using nitrogen from cylinder 16. The exit gas line 18 is preferably of stainless steel and is equipped with a relief valve 20 to maintain essentially atmospheric pressure. Aqueous spray nozzle 22 located at the inlet to cyclone separator 24 may be controlled with temperature controller 23 to maintain a temperature below 100 degrees C. with a set minimum flow. This aqueous spray or demister acts to coalesce very fine activated carbon formed by pyrolysis of the waste.

The carbon-slurry draw-off valve 26 may advantageously be of the star feeder type to allow continuous draw off to the carbon and water separation unit 30 while the unit is operating. The water separated from the unit is pumped through cooling tower 32 to recycle through aqueous spray nozzle 22. Gas circulating fan 28 circulates exit gas back to removeable top head 1 of the reactor.

Figure 2:
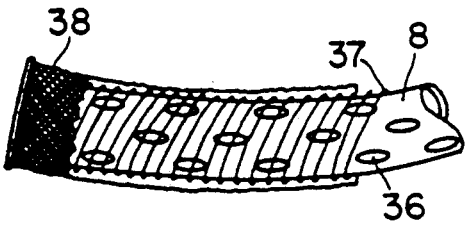
FIG. 2 shows detail of inlet feed end with a platinum screen to catalyze the reaction.

In FIG. 2 we show details of the exit end of interior liquid feed coil 8. High temperature ceramics such as sillimanite, and tantalum metal should be satisfactory materials of construction for this coil. In embodiments wherein platinum is used to catalyze the reactions, holes 36 in coil 8 may be covered with platinum wire 37 closely spaced to cause smaller bubbles of the waste to enter the molten bed. In other embodiments, particularly those handling a slurry, a loose platinum screen 38 may be used to achieve greater dispersion in the molten alloy bed.

Where the waste stream is pumped, various other mixers such as venture mixers could be used ahead of the tip with the catalytic screen.

What is claimed is:

1. A hazardous waste reclamation process comprising:

(a) charging a reactor means with an alloy metal means;

(b) heating said alloy metal means in said reactor means to a minimum of 800 degrees C to from a molten alloy bed;

(c) introducing at a controlled rate liquid and slurries thru a feed coil means into said molten alloy bed with outlet openings of said feed coil means near a bottom portion of said molten alloy bed and an inlet end of said feed coil means exterior of said molten alloy bed;

(d) circulating an exit gas from said reactor means at essentially atmospheric pressure thru a separator means and back to a surface of said molten alloy bed.

2. A hazardous waste reclamation process as in claim 1 wherein a water spray means is installed in an inlet to said separator means and wherein there is a draw off valve to allow drawing off a slurry from said separator means.

3. A hazardous waste reclamation process as in claim 1 wherein said heating is accomplished with an induction heater.

4. A hazardous waste reclamation process as in claim 1 wherein a cooling means in a jacket of said reactor means may be used to cool said molten alloy bed.

5. A hazardous waste reclamation process as in claim 1 wherein an expendable metal hook is placed in said molten alloy bed before cooling, thereby allowing an easy connection for handling an ingot formed by cooling said molten alloy bed.

6. A hazardous waste reclamation process as in claim 1 wherein a minimum of one layer of platinum wire is wound around and over said outlet openings of said feed coil means.

7. A hazardous waste reclamation process as in claim 1 wherein a platinum screen loosely encases said outlet openings of said feed coil means.

8. A hazardous waste reclamation process as in claim 2 wherein separating a recycling water from said slurry thru a cooling tower furnishes flow to said spray.

9. A hazardous waste reclamation process as in claim 1 wherein charging thru a charging chute means in a top head of said reactor means allows charging of a solid waste to a surface of said molten alloy bed with minimum admission of air while charging.

10. A hazardous waste reclamation process as in claim 1 wherein said molten alloy means comprises a mixture of copper, zinc, calcium, iron and aluminum.

11. A hazardous waste reclamation process comprising:

(a) feeding a liquid waste stream underneath a surface of a molten alloy means in a reactor means, said reactor means being heated to maintain said molten alloy means at a minimum of approximately 800 degrees C.;

(b) circulating in a closed system an exit gas from said reactor means through a separator means and back to a surface of said molten alloy means;

(c) separating from said separator means an activated carbon formed from reactions in said molten alloy means.

12. A hazardous waste reclamation process as in claim 11 wherein exit holes in a feed line to allow feeding said liquid waste stream underneath said surface are covered with a porous platinum catalyst means.

13. A hazardous waste reclamation process as in claim 11 wherein an aqueous spray means in an inlet end of said separator means acts to coalesce said activated carbon.

14. A hazardous waste reclamation process as in claim 13 wherein water separated from said activated carbon is recycled through a cooling tower to said aqueous spray means.

15. A hazardous waste reclamation process as in claim 11 wherein said molten alloy means comprises approximately 50 percent aluminum, 5 to 15 percent calcium, 5 to 15 percent copper, 5 to 15 percent iron, and 5 to 15 percent zinc.

16. A hazardous waste reclamation process comprising:

(a) feeding solid waste material through a feed chute means to a surface of a molten alloy means in a reactor means, said reactor means being heated to maintain said molten alloy means a minimum of approximately 800 degrees C.;

(b) circulating in a closed system an exit gas from said reactor means through an aqueous spray at an inlet of a separator and back to a surface of said molten alloy means;

(c) drawing off from said separator an activated carbon formed from reactions in said molten alloy means.

17. A hazardous waste reclamation process comprising:

(a) pyrolyzing a hazardous waste material in contact with a molten alloy means in a heated reactor said molten alloy means comprising individual metals chosen to form low energy level salts and free carbon from said hazardous waste material;

(b) separating said free carbon from an exit gas stream from said reactor.

18. A hazardous waste reclamation process as in claim 17 wherein said exit gas stream is fed to a cyclone separator with an aqueous spray at an inlet of said cyclone separator to coalesce said free carbon in said exit gas stream.

19. A hazardous waste reclamation process as in claim 17 wherein said heated reactor is heated with an induction heater.

* * * * *